US006601866B1

(12) United States Patent
Dobies

(10) Patent No.: US 6,601,866 B1
(45) Date of Patent: Aug. 5, 2003

(54) WHEELCHAIR CLAMP

(76) Inventor: Henry J. Dobies, 173 E. Orvis St., Massena, NY (US) 13662

( * ) Notice: Subject to any disclaimer, the term of this patent is extended or adjusted under 35 U.S.C. 154(b) by 0 days.

(21) Appl. No.: 10/190,023

(22) Filed: Jul. 8, 2002

(51) Int. Cl.[7] ..... A61G 5/00
(52) U.S. Cl. ..... 280/304.1; 248/68.1; 403/391
(58) Field of Search ..... 280/304.1, 209; 248/68.1, 73, 74.2; 403/293, 391

(56) References Cited

U.S. PATENT DOCUMENTS 556,168 A * 3/1896 Taylor ..... 280/209
4,805,938 A * 2/1989 Redmond et al. ..... 280/47.35
5,529,427 A * 6/1996 Bost ..... 403/391
6,182,529 B1 * 2/2001 White ..... 74/551.1

FOREIGN PATENT DOCUMENTS

DE 2306969 A * 11/1973
JP 10179646 A * 7/1998 ..... A61G/5/00

* cited by examiner

*Primary Examiner*—Kevin Hurley
(74) *Attorney, Agent, or Firm*—Bernhard P. Molldrem, Jr.

(57) ABSTRACT

A wheelchair clamp connects together a pair of wheelchairs situated side by side so that one attendant can move two wheelchair patients at the same time. The clamp member is a U-shaped member or an E-shaped member with end portions that project from the ends of a cross bar. These end portions extend into the tubular handles of the two wheelchairs. A clamp bar is fastened down by a hand wheel with a threaded post that passes through the clamp bar into a central portion of the clamp member. The cross bar can have a rubbery coating to facilitate gripping.

10 Claims, 2 Drawing Sheets

WHEELCHAIR CLAMP

BACKGROUND OF THE INVENTION

This invention relates adapter handles for wheelchairs and other wheeled devices and vehicles that are propelled by pushing against a handle, such as a baby carriage or stroller, and is more particularly concerned with a device that can link two (or more) wheelchairs together so that one attendant can move two or more wheelchair patients at the same time.

The invention is more specifically concerned with a clamp device in the nature of an adapter handle that can clamp to two or more such wheeled devices, where the wheeled devices have a pair of tubular handles that extend from above and behind the vehicle, so that the adapter handle can attach to one of the tubular handles of each of the two wheelchairs or other wheeled devices.

There is a need for a device that connects two wheelchairs together, for example, in a hospital or rest home, so that one attendant can move multiple patients at the same time, or can move two patients over some distance without having to leave one of them unattended while he or she moves the other one.

At the present time, there are clamps that are used for children's strollers, in which the tubular frames of a pair of strollers are clamped together, for example, as discussed in U.S. Pat. No. 5,918,892 to Aaron et al. A number of wheelchair handle adapters have also been proposed, which connect between the two tubular handles of a given wheelchair so that the attendant can push from the center. Typical examples of wheelchair handle adapters are discussed in U.S. Pat. No. 4,708,357 to Soderbaum, U.S. Pat. No. 4,964,648 to Berkowitz, and U.S. Pat. No. 5,529,427 to Bost. A tubular push bar handle that slips over the two tubular handles of a given wheelchair is discussed in U.S. Pat. No. 5,290,055 to Treat, Jr. None of these suggests an effective means for joining the handles together of a pair of wheelchairs so that the attendant can safely move the two chairs, together with the associated patients.

Currently, for an attendant to bring any low mobility patient from one part of a medical care facility to another, the patient is placed in a wheelchair and has to be pushed individually to the distant part of the facility. If there is more than one patient to be moved, but only the one attendant, this can involve making multiple trips through the facility, and as a result one of the two patients has to be left unattended while the other is being wheeled to the new location. The only current technique used to moving two wheelchairs at once is to push one and pull the other, which can lead to falls or discomfort both for the patients and for the attendant.

OBJECTS AND SUMMARY OF THE INVENTION

Accordingly, it is an object of this invention to provide a simple and straightforward wheelchair clamp device that facilitates joining two wheelchairs so that an attendant can move plural wheelchair patients at one time.

It is another object to provide a wheelchair clamp that is convenient to use and which securely grips onto the handles of the wheelchairs.

In accordance with an aspect of the present invention, a wheelchair clamp device can be in the form of a generally U-shaped member in which the two ends of the U, i.e., the two end bars, fit into the handle tubes of the wheelchair, with one end bar in the left handle of one chair and the other end bar in the right handle of the other. A clamp bar or an equivalent means clamps down against the handle grips of the two chairs so that the device is firmly secured to the two chairs. In a preferred embodiment, the clamp member has a central bar that is midway between and parallel to the two end bars, so that the device in such case is generally E-shaped overall. The clamp bar lies against the handle grips of the two wheelchairs, and is tightened down onto the central bar using a hand wheel, with a threaded post in the wheel passing through a hole in the clamp bar and into a threaded opening in the central bar. The crossbar portion of the clamp device can be covered with a resilient plastic or hard-rubber coating for better gripping with the attendant's hands. There are many other ways in which the end bars of the clamp device can grip securely onto the tubular handles of the wheelchairs, e.g., with individual clamps on the two end bars either gripping the interior of the handle tube or the outside of the handle grip. The crossbar is a straight member in the disclosed embodiment, but in other embodiments may be curved for better gripping or for other reasons.

The above and many other objects, features, and advantages of this invention will become apparent to persons skilled in the art from the ensuing description of a preferred embodiment, which is to be read in conjunction with the accompanying Drawing.

DETAILED DESCRIPTION OF THE PREFERRED EMBODIMENT

Figure 1:
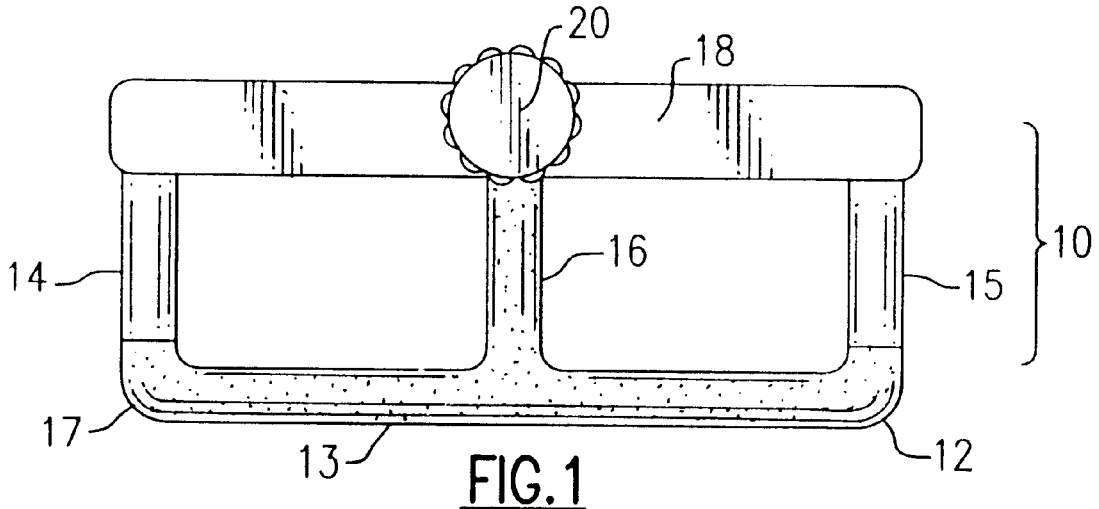
FIG. 1 is a top plan view of the device of one embodiment of this invention.
Figure 2:
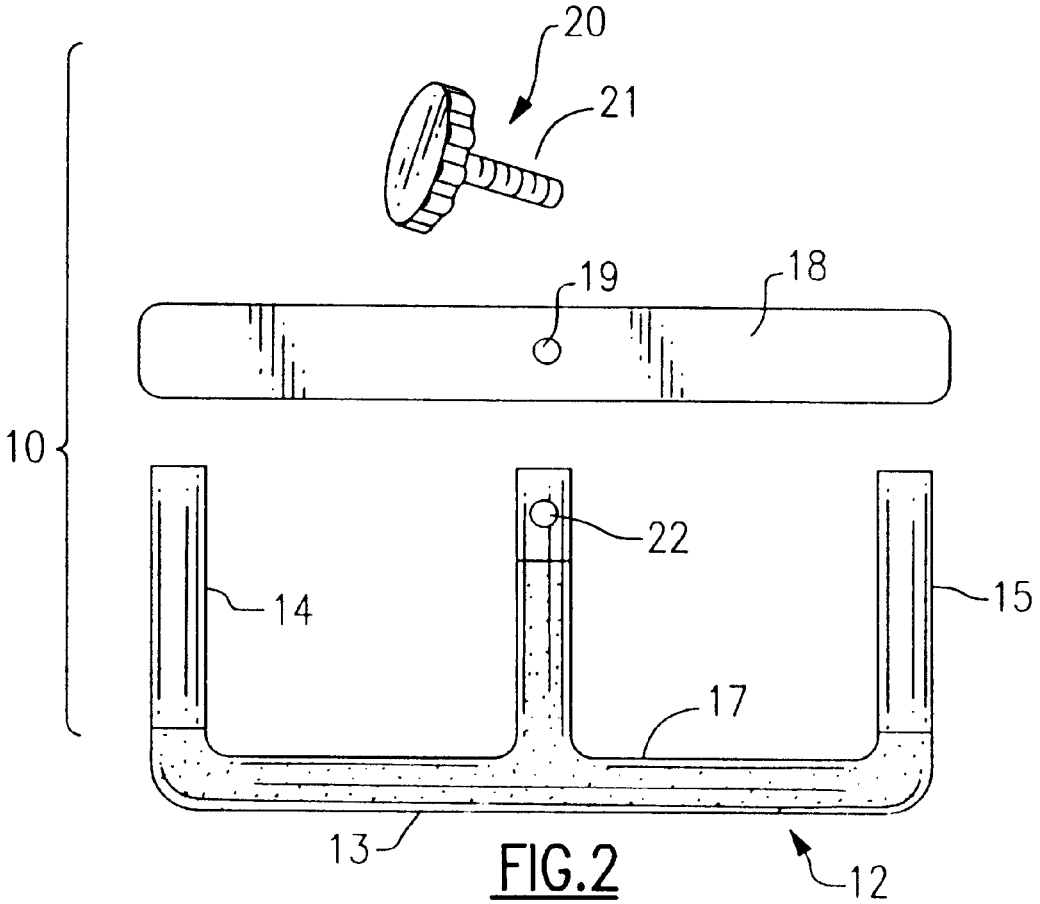
FIG. 2 is an assembly view of this embodiment.

With reference to the Drawing, and initially to FIGS. 1 and 2, a wheelchair clamp 10 includes clamp member 12 that is formed of generally round solid or tubular stock, i.e., of round cross section, and can be seen to be generally U-shaped with a third arm between the arms of the U, or alternatively as an E-shaped member. The clamp member 12 has a transverse cross bar 13, a left end leg 14 that extends generally at a right angle to the cross bar, and a right end leg 15 that also extends at a right angle to the cross bar 13, i.e., parallel to the other end leg 14. A center leg member 16 extends parallel to the end legs 14 and 15, and midway between them, i.e., from a midpoint of the cross bar 13. The cross bar 13 can preferably have a coating of a rubbery or plastic material 17, which can faciltate gripping by the attendant. This coating can extend up the central leg member 16, but does not extend up the end leg members 14, 15.

A clamp bar 18 is shown here as a flat length of bar stock that extends the width between the two end members 14, 15, and this bar 18 is fastened onto the center leg member 16 by means of a hand wheel 20. As shown here, a threaded post 21 that is affixed onto the wheel 20 extends through an opening 19 in the clamp bar 18 and into a threaded opening 22 in the center leg member 16, so that the bar 18 can be tightened down by hand against the handles of a pair of wheelchairs when the clamp member 12 is in place, as explained below with reference to FIG. 3.

Figure 3:
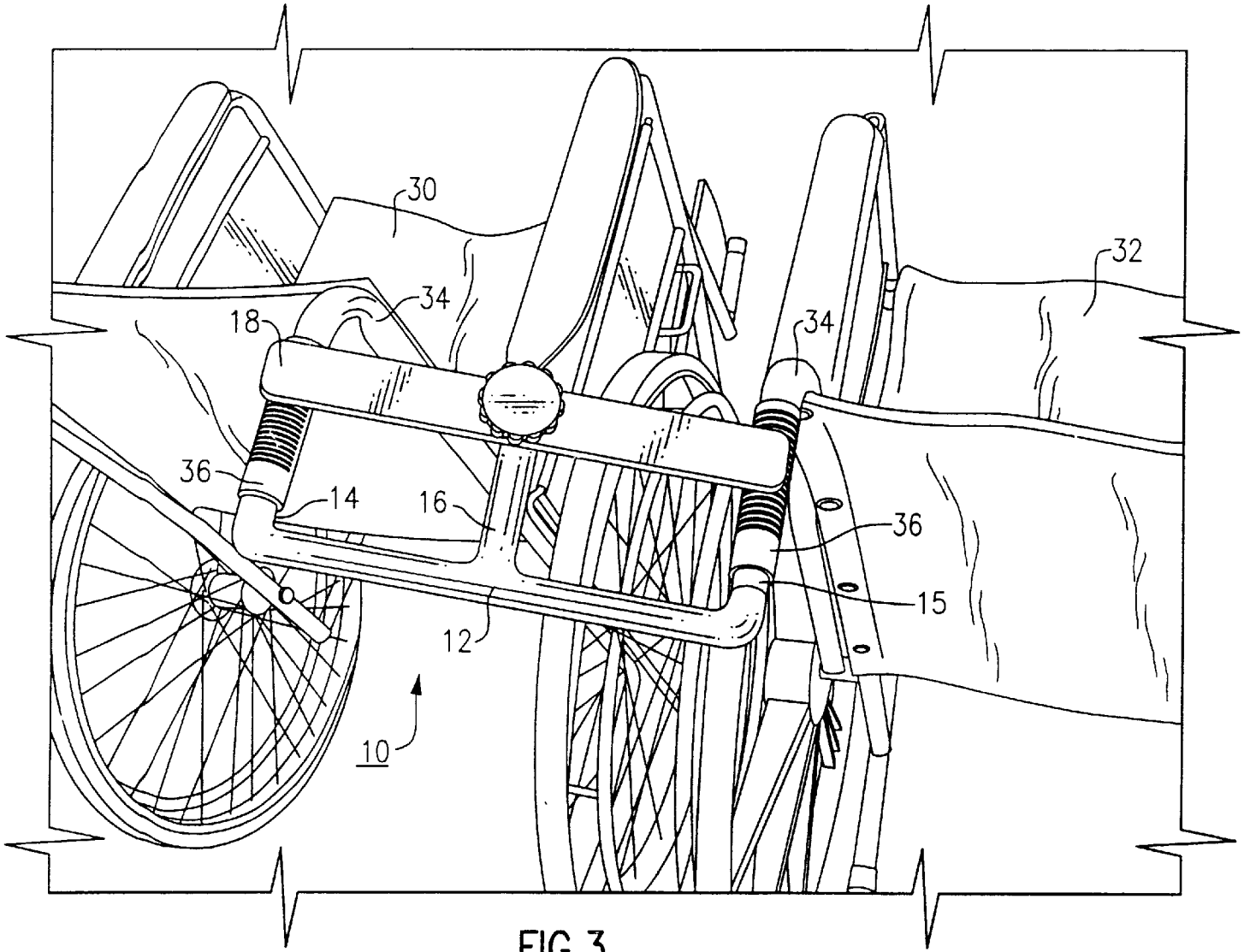
FIG. 3 is a perspective view showing device according to an embodiment of this invention in place in the tubular handles of two wheelchairs placed side by side.

FIG. 3 is a perspective view showing the wheelchair clamp 10 of this embodiment used to connect together two wheelchairs 30 and 32, which are positioned side by side, so that the attendant can push the two wheelchairs with his hand on the cross bar 13 of the clamp 10. Each of the wheelchairs 30 and 32 has a pair of tubular frame handles 34, with the right handle of the wheelchair 30 and the left handle of the wheelchair 32 being shown here. Each handle 34 has a rubber grip 36.

To fit the clamp member 12 into the two handles 34, 34, the ends of the grips 36 can be cut away to reveal the open ends of the handle tubes. The round end legs 14 and 15 have a diameter smaller than the interiors of the tubular handles of the wheelchairs, and fit into the tubular handles 34, 34. The clamp bar 18 is tightened down against the grips 36, by rotating the hand wheel 20. This clamps the clamp member 12 securely to the two handles of the respective wheelchairs 30 and 32 so that they will stay together and in a side by side orientation when the attendant moves the two chairs.

It is possible to use an additional clamp, or clamps, to join more than two wheelchairs for moving more than two patients at the same time, providing there is adequate clearance in the hallway or other passageway.

While this embodiment uses a straight transverse cross bar 13, it is entirely possible to employ a curved cross bar or other shape member in place of the illustrated cross bar 13. Also, it is possible to use different means to hold the clamp member 12 in place onto or into the wheelchair handles, instead of the clamp bar 28 and hand wheel 20. For example, there could be a pair of clamp members, one for each end member 14, 15, or there could be a collet type gripping means for gripping to the inside of the tubular handles. Also, while a metal clamp is preferred, a suitable reinforced plastic could be used in many applications.

While the invention has been described in detail with respect to a preferred embodiment, it should be recognized that there are many alternative embodiments that would become apparent to persons of skill in the art. Many modifications and variations are possible which would not depart from the scope and spirit of this invention, as defined in the appended claims.

I claim:

1. Wheelchair clamp device for clamping two wheelchairs together to permit an attendant to move two or more wheelchair patients at a time; comprising a clamp member including a crossbar, a pair of cad bars extending parallel to one another from the crossbar, and a center bar extending from the crossbar midway between the end bars and generally parallel thereto;

a clamp bar separate from said clamp member and extending across said end bars of said member; and hand-tightable means connecting a central portion of said clamp bar with the center bar of said clamp member for permitting the attendant to clamp the clamp bar securely to the end bars of the clamp member when the wheelchair clamp device is in place on said wheelchairs.

2. Wheelchair clamp device according to claim 1 wherein said crossbar is generally straight and said end bars are at a right angle to the crossbar.

3. Wheelchair clamp device according to claim 1 wherein said hand-tightenable means includes a hand wheel having a threaded post thereon that extends through an opening in said clamp bar into a threaded opening in said center bar.

4. Wheelchair clamp device according to claim 1 wherein at least the crossbar of said clamp member is coated with a rubbery coating to facilitate gripping.

5. In combination, first and second wheelchairs each having tubular handles disposed at an upper rear side of the respective wheelchair, the tubular handles each having a open interior;

a wheelchair clamp member formed of a crossbar and end bars that extend from first and second ends of the crossbar, said end bars having a diameter smaller than the interiors of said tubular handles of said wheelchairs, with said first end bar entering into the interior of one handle of one of the wheelchairs and the second end bar entering into the interior of one handle of the other of the wheelchairs; and hand-actuable means for clamping said end members of said clamp member in place in the respective wheelchair handles, for permitting an attendant to clamp the wheelchair clamp member securely to associated handles of said wheelchairs.

6. The combination of claim 5 wherein said first and second ends of said wheelchair clamp member are of generally round cross section.

7. The combination of claim 5 wherein said hand-actuable means for clamping includes a clamp bar that extends across said fire and second end bars and lies against the one handle of each of said wheelchairs; and hand-tightenable means connecting said clamp bar onto a portion of said clamp member.

8. The combination of claim 7 wherein said clamp bar is a generally flat rigid member.

9. The combination of claim 7 wherein said hand-tightenable means includes a hand wheel having a threaded post thereon that extends through an opening in said clamp bar into a threaded opening in, a portion of said clamp member.

10. The combination of claim 5 wherein at least the crossbar of sad clamp member is coated with a rubbery coating to facilitate gripping.

* * * * *

UNITED STATES PATENT AND TRADEMARK OFFICE

CERTIFICATE OF CORRECTION

PATENT NO. : 6,601,866 B1
DATED : August 5, 2003
INVENTOR(S) : Henry J. Dobies

It is certified that error appears in the above-identified patent and that said Letters Patent is hereby corrected as shown below:

Column 3,
Line 44, “cad” should read -- end --
Line 49, “said member” should read -- said clamp member --

Column 4,
Line 49, “sad” should read -- said --

Signed and Sealed this

Twenty-third Day of September, 2003

JAMES E. ROGAN
*Director of the United States Patent and Trademark Office*